US006161832A

United States Patent [19]

Holahan et al.

[11] Patent Number: 6,161,832

[45] Date of Patent: Dec. 19, 2000

[54] STACKING BLOCK GAME

[75] Inventors: Edward Thomas Holahan; Craig Dennis Sellers, both of Chicago, Ill.

[73] Assignee: Irwin Toy Limited, Canada

[21] Appl. No.: 09/239,805

[22] Filed: Jan. 29, 1999

[51] Int. Cl.[7] ..... A63F 9/08; A63F 3/00

[52] U.S. Cl. ..... 273/241; 273/287; 273/153 S; 273/290; 273/450

[58] Field of Search ..... 273/241, 290, 273/271, 287, 451, 459, 153 S, 450

[56] References Cited

U.S. PATENT DOCUMENTS

| | | | |
|---|---|---|---|
| 1,749,653 | 3/1930 | Winter | 273/309 |
| 2,071,014 | 2/1937 | Akers | 273/299 |
| 3,778,063 | 12/1973 | Strand | 273/241 |
| 3,831,945 | 8/1974 | Scherini | 273/148 R |
| 3,863,918 | 2/1975 | Kramer | 273/450 |
| 4,215,585 | 8/1980 | Olsen | 273/447 |
| 4,303,240 | 12/1981 | Ellman et al. | 273/450 |
| 4,303,246 | 12/1981 | Strongin | 273/153 S |
| 4,508,348 | 4/1985 | Lapointe | 273/157 R |
| 4,522,393 | 6/1985 | Dunn | 273/447 |
| 4,852,878 | 8/1989 | Merrill | 273/156 |
| 5,018,743 | 5/1991 | Maier et al. | 273/242 |
| 5,080,370 | 1/1992 | Lu | 273/260 |
| 5,611,544 | 3/1997 | Grebler et al. | 273/447 |
| 5,857,673 | 1/1999 | Ablonczy et al. | 273/153 S |

FOREIGN PATENT DOCUMENTS

| | | | |
|---|---|---|---|
| 602970 | 8/1960 | Canada | 273/241 |
| 0 190 876 | 8/1986 | European Pat. Off. . | |
| 2 130 105 | 5/1984 | United Kingdom . | |
| 2 185 691 | 7/1987 | United Kingdom . | |
| 2 307 867 | 6/1997 | United Kingdom . | |

*Primary Examiner*—Benjamin H. Layno
*Attorney, Agent, or Firm*—Fitzpatrick, Cella, Harper & Scinto

[57] ABSTRACT

A stacking block game includes a plurality of game blocks stackable in layers, and an elongate sleeve comprising four planar sides defining an interior for retaining the game blocks in layers in the interior. Apertures are provided in the sides, coincide with the game block layers and are dimensioned for passing the game blocks therethrough. The game blocks have a cuboid shape and colored indicia on the faces thereof, and are inserted in the sleeve interior in layers of four game blocks. The stacking block game is played by assigning a different indicia to each player, and then each player ejecting one of the game blocks from the sleeve interior, in turn, by pressing a previously-ejected game block through one of the apertures and against a game block opposite the game block to be ejected. Generally, each player makes a note of the indicia on the uppermost face of the previously ejected game block, and then presses that game block against the indicia of a game block in the sleeve matching the noted indicia. However, if the indicia on the uppermost face of the game block ejected on a player's turn matches that player's assigned indicia, the player repeats the turn and is entitled to press the ejected game block against any of the game blocks in the sleeve. The players take turns ejecting game blocks until all of the colored indicia adjacent one of the sides match one of the player's assigned indicia.

27 Claims, 3 Drawing Sheets

STACKING BLOCK GAME

FIELD OF THE INVENTION

The present invention relates to a game which is played using a set of stackable game pieces. In particular, the present invention relates to a game which employs a set of game blocks, carrying indicia on their faces, and a frame for stacking the game blocks within the frame member.

BACKGROUND OF THE INVENTION

Games using stackable game pieces are well known. For instance, in U.S. Pat. No. 3,863,918, Kramer teaches a game in which players are provided with a set of game pieces of various shapes, and are required to stack the game pieces on top of each other in layers without causing the structure to collapse. Although such games may be suitable for young children, their simplicity would not maintain the interest of older children or adults.

Other games using stackable game pieces have been developed having a greater level of difficulty than the traditional stacking piece game. In one such game, marketed under the trade-mark JENGA, a tower is constructed from a set of game blocks of generally elongate parallelepiped shape, with the blocks in each layer being perpendicular to the blocks in the layer above and the layer below. Players are required to remove a block from the tower and place it on the uppermost layer without toppling the tower. The ability to strategically select game blocks from the tower increases the level of difficulty of the game.

More recently, a game marketed under the trade-mark JENGA ULTIMATE was developed having an even greater level of difficulty than JENGA. The game is played in a manner similar to JENGA, but employs of set of elongate coloured parallelepiped game blocks. A player rolls a die having coloured faces matching the colours on the game blocks, with the colour of the uppermost die face determining the colour of the game block which can be removed from the tower. By so limiting the number of blocks which can be removed, the level of difficulty of the game is increased.

Although JENGA and JENGA ULTIMATE have been commercially successful, it is desirable to provide a stacking game using stackable game pieces which produces an even greater level of difficulty.

SUMMARY OF THE INVENTION

The stacking block game, according to the invention, comprises a plurality of game pieces stackable in layers, the game pieces including indicia on the faces thereof. The stacking block game also comprises an elongate sleeve comprising a side wall defining an interior for retaining the game pieces in layers in the interior, and a plurality of apertures provided in the side wall and coinciding with the game piece layers, the apertures being dimensioned for sliding the game pieces therethrough.

Preferably, the sleeve has a rectangular parallelepiped shape, and comprises four sides which extend upwardly from a base. The game pieces have a cuboid shape and are inserted in the sleeve interior in layers of four game pieces, each layer comprising two rows of two game pieces. The apertures have a rectangular shape and extend substantially the entire width of the sides to allow access to two game pieces through each side. The apertures are staggered, such that the apertures in one pair of opposing sides coincide with alternate layers of the game piece layers, and the apertures in the adjacent sides coinciding with the game piece layers disposed therebetween.

The stacking block game is played by first depositing all but one of the game pieces in layers in the interior of the elongate sleeve. One of the players then ejects a first of the game pieces from the interior by pressing the remaining game piece through one of the apertures and against a second of the game pieces, with the second game piece being disposed opposite the first game piece. The second game piece is selected in accordance with a set of rules, described below. The next player takes the ejected game piece and presses it through one of the apertures and against another of the game pieces, to eject another game piece from the sleeve. The players of the game take turns executing the ejecting step until a predetermined indicia solution is reached. Preferably, the players are initially assigned different indicia, and a player achieves the desired solution when all of the indicia adjacent one of the sides of the sleeve are identical to the player's assigned indicia.

Generally, the indicia of the uppermost face of the ejected game piece, after the ejected game piece has come to rest, determines the game piece against which the ejected game piece can be pressed. Specifically, each player can only press the ejected game piece against the face of a game piece having an indicia which matches the indicia of the uppermost face of the ejected game piece. However, in one variation, the player repeats his/her turn as long as the indicia of the uppermost face of the ejected game piece matches the player's assigned indicia. In another variation, a mat having demarcated zones thereon is provided, and the sequence of play and/or the target indicia of a player changes in accordance with the zone in which the ejected game piece comes to rest on the mat.

BRIEF DESCRIPTION OF THE DRAWINGS

The preferred embodiment of the invention will now be described, by way of example only, with reference to the drawings, in which.

DETAILED DESCRIPTION OF THE PREFERRED EMBODIMENT

Figure 1:
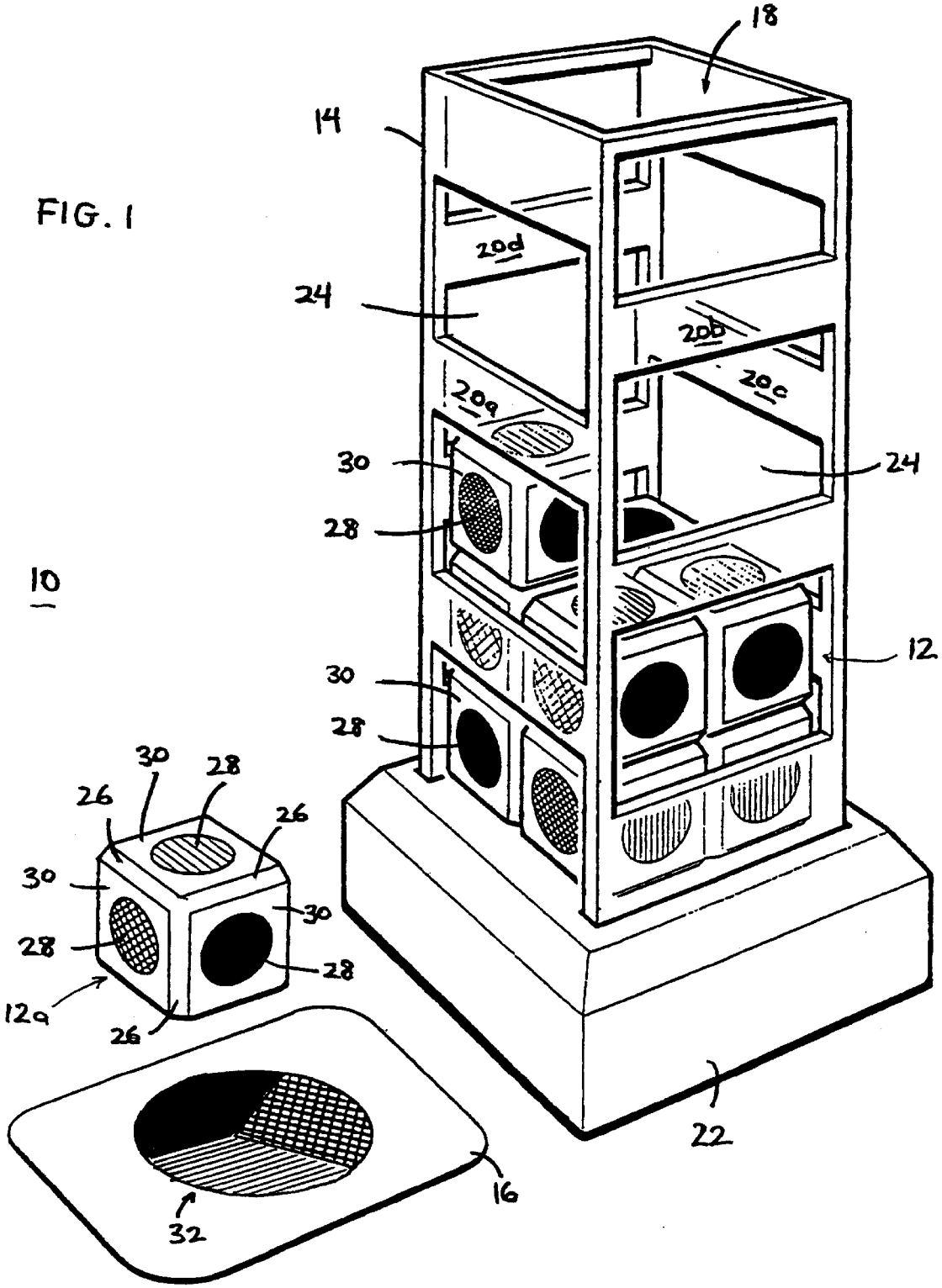
FIG. 1 is a perspective view of the stacking block game according to one embodiment of the invention, showing the game pieces, the elongate sleeve for retaining the game pieces, and the mat.

Turning to FIG. 1, a stacking block game, denoted generally as 10, is shown comprising a plurality of game pieces 12, and an elongate sleeve 14 for retaining the game pieces 12 in layers in the sleeve 14. Optionally, the stacking block game 10 also includes a mat 16 upon which the game pieces 12 are ejected from the sleeve 14.

The elongate sleeve 14 has a rectangular parallelepiped shape and an interior 18 with a square transverse cross-section. However, the interior 18 of the sleeve 14 may also adopt any other parallelepiped shape with an interior 18 having a generally parallelogram-shaped transverse cross-section without departing from the scope of the invention. The sleeve 14 has a uniform transverse cross-section and is shown being dimensioned to allow the game pieces 12 to be deposited in layers of four game pieces in the interior 18, with each layer comprising two rows of two game pieces 12. However, the sleeve 14 may also be dimensioned to allow a different number of game pieces 12 to be deposited in each layer, and may have a non-uniform transverse cross-section, if desired, to allow the sleeve 12 to retain different numbers of game pieces 12 in each layer. For instance, the sleeve 14 may be dimensioned to retain nine game pieces 12 (arranged as three rows of three game pieces 12) in each layer, or may be dimensioned to retain four game pieces 12 (arranged as two rows of two game pieces 12) in even-numbered layers and nine game pieces 12 (arranged as three rows of three game pieces 12) in odd-numbered layers.

The sleeve 14 comprises four substantially identical planar sides 20*a,* 20*b,* 20*c,* 20*d* which extend upwardly from a common base 22, and a plurality of apertures 24 provided in the sides 20 and coinciding with the layers of game pieces 12 to allow access to the game pieces 12. Preferably, the sleeve 14 is injection molded as a single transparent plastic piece. However, the sleeve 14 may also be fabricated from four interlocking planar plastic sheets, opaque or transparent, or from non-polymeric material if desired.

The base 22 stabilizes the sides 20, and preferably includes a smooth bottom surface to allow the sleeve 14 to be pivoted on the playing surface as the game is played. In one variation, the base 22 is disposed above a base plate (not shown) and is coupled to the base plate through an axially-extending rotatable shaft to allow the sleeve 14 to be easily rotated between players.

Preferably, each aperture 24 has a generally rectangular shape and a width which is substantially equal to the width of the respective side 20, and greater than the width of a single layer of game pieces 12, to allow unrestricted access to a single layer of game pieces 12. Further, each aperture 24 has a height which is slightly greater than the height of a single layer of game pieces 12, but less than the height of two layers of game pieces 12, to allow for variations in the size of the game pieces 12. However, in one variation (not shown), the height of each aperture 24 is slightly greater than the height of two layers of game pieces 12.

As shown in FIG. 1, each layer of game pieces 12 is accessible through an aperture 24 provided in one of the sides 20 and through a corresponding aperture 24 provided in the opposing side 20. However, in one variation, shown in FIG. 2, each side 120 of the sleeve 114 include pairs of adjacent apertures 124 whose respective widths are slightly greater than the width of a single game piece 12, so that only a single game piece 12 is accessible through each aperture 124. In this variation, the sleeve 114 includes a vertical planar dividing wall 125 extending between one pair of adjacent apertures 124 and the opposing pair of adjacent apertures 124 to allow the game blocks 12 to slide smoothly between each opposing aperture pair.

Figure 2:
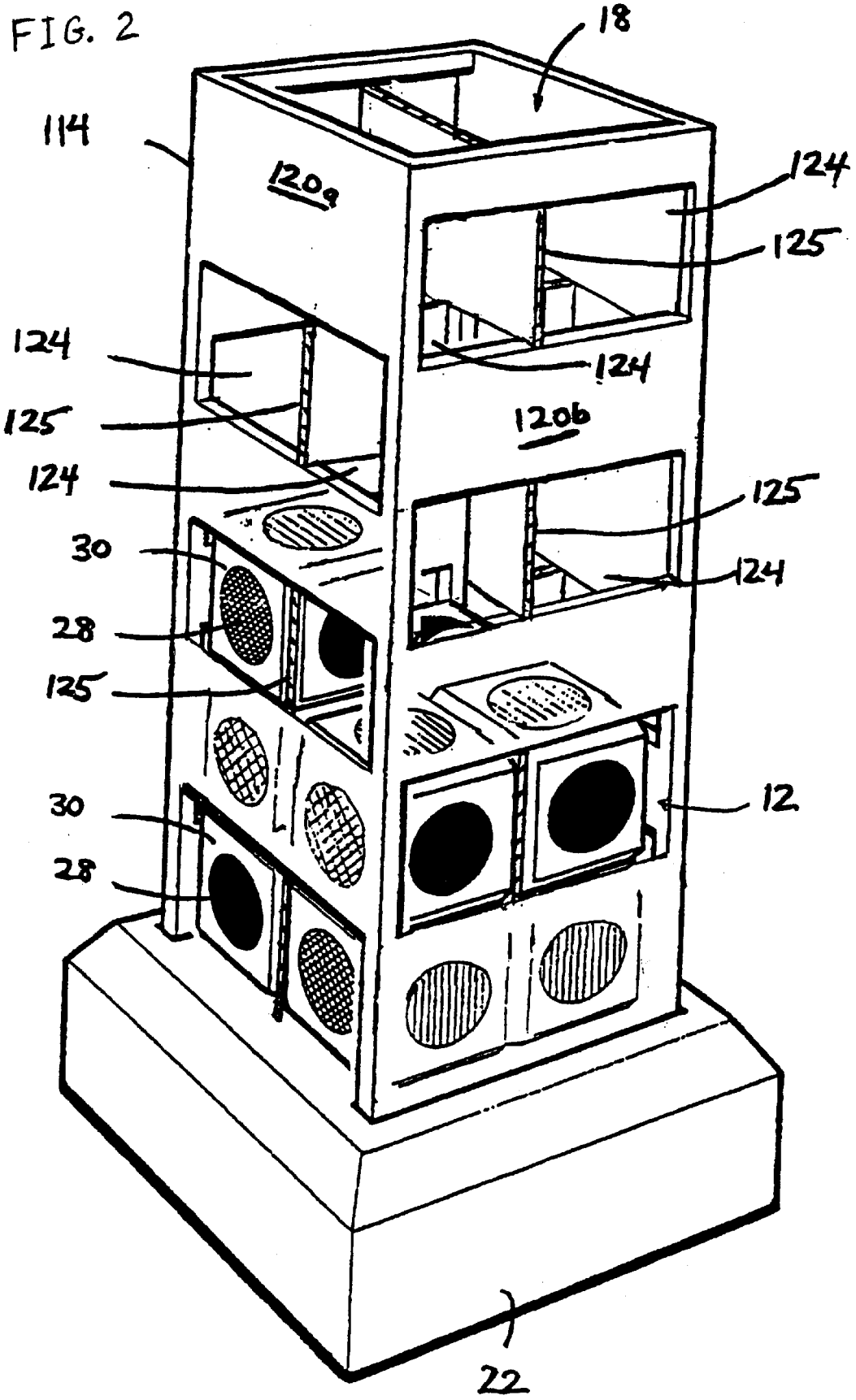
FIG. 2 is a perspective view of one variation of the stacking block game shown in FIG. 1.
Figure 3:
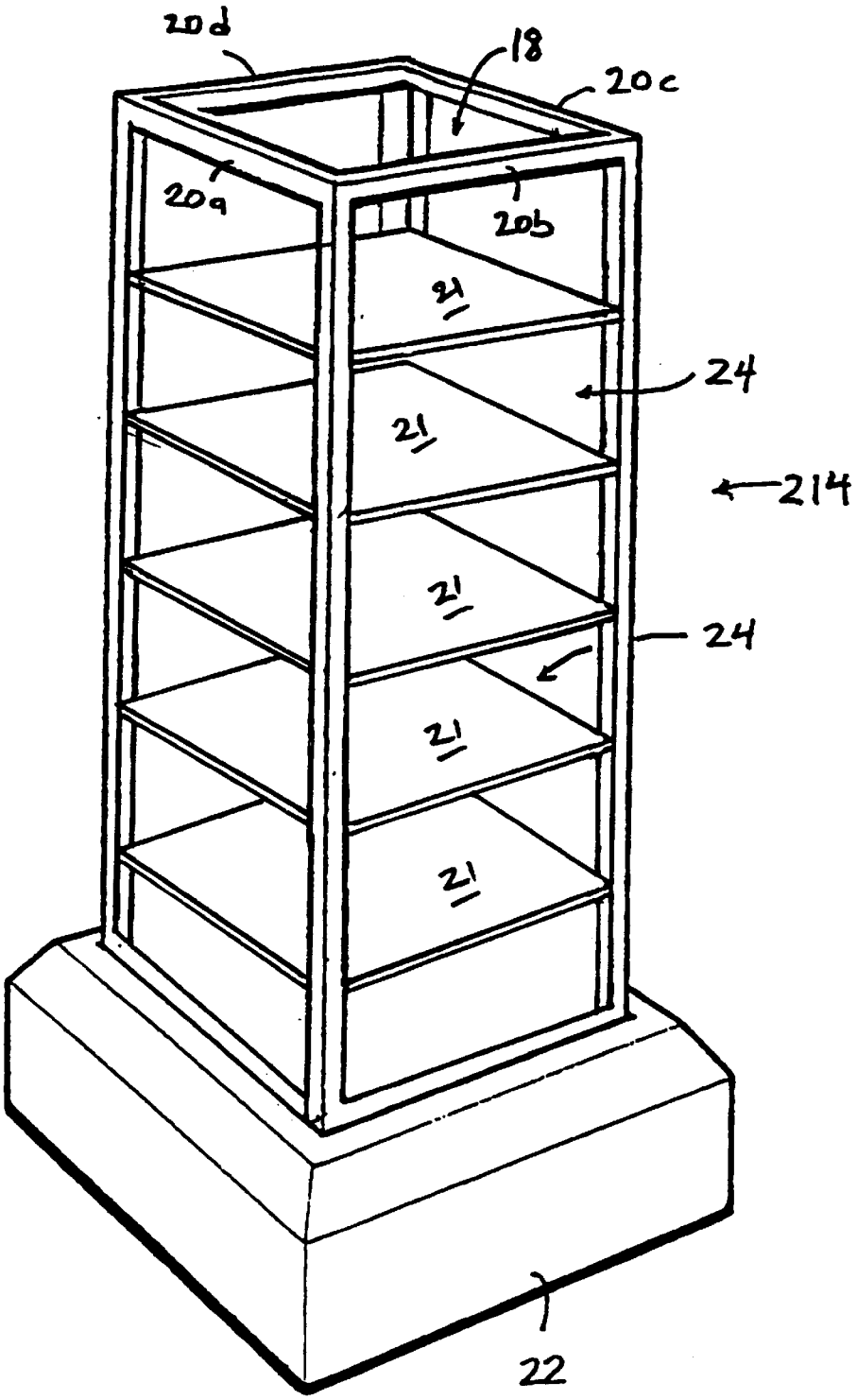
FIG. 3 is a perspective view of another variation of the stacking block game.

As shown in FIGS. 1 and 2, the apertures 24 are staggered, such that the apertures 24 in the sides 20*a,* 20*c* coincide with the even numbered layers of game pieces 12 and the apertures 24 in the sides 20*b,* 20*d* coincide with the odd numbered layers of game pieces 12. As will be described below, this orientation of apertures 24 allows game pieces 12 to be ejected from one layer without disturbing the game pieces 12 in the layer above and below. However, in another variation, shown in FIG. 3, the sleeve 214 includes apertures 24 which are disposed such that a portion of the layers are simultaneously accessible through the apertures 24 from all of the sides 20. To avoid disturbing game pieces 12 in the adjacent layers when a game piece 12 is ejected from the interior 18, the sleeve 214 includes a plurality of horizontal planar floor members 21, which are fabricated as separate pieces and which are supported by flanges (not shown) extending inwardly from the sides 20. The floor pieces 21 are then laid in place in the interior 18 as each layer of game pieces 12 is formed. With this latter variation, a portion of the apertures 24 may extend across only a portion of the width of the respective side 20, if desired. Other means of maintaining the adjacent layers in place will be apparent to those skilled in the art.

The game pieces 12 are shown in FIG. 1 having a cuboid shape and the transverse cross-section of the sleeve 14 substantially corresponds with the cross-section of the game pieces 12. As a result, the game pieces 12 are easily ejected from the interior 18, in accordance with the method of playing the game (described below), by sliding the game piece 12 to be ejected in a direction parallel to one of the sides 20. As will be appreciated, if the interior 18 of the sleeve 14 adopts a transverse cross-section other than the square transverse cross-section shown in FIG. 1, the game pieces 12 need only have a cross-section which is substantially similar to the transverse cross-section of the interior 18 to allow the game pieces 12 be easily ejected from the interior 18. As a result, the game pieces 12 may have any non-cuboid shape parallelepiped shape, and may even have a tubular shape with planar end faces and arcuate side faces at the expense of a reduced number of game piece faces 30. Further, the sleeve 14 may even be shaped as a right cylinder with an interior 18 having a parallelogram-shaped transverse cross-section without departing from the scope of the invention.

Preferably, the game pieces 12 are beveled at their edges 26 to facilitate tumbling of the game piece 12 after being ejected from the sleeve 14, and are fabricated from a hard plastic material to prevent the game piece 12 from being damaged. The game pieces 12 include indicia 28 provided on their faces 30. Each indicia 28 is recessed below the surface of the respective face 30 to minimize damage to the indicia 28. Preferably, the indicia 28 comprise a set of three different colours, with each colour being disposed on two adjacent faces 30 of the game pieces 12. As will become apparent, this orientation of coloured indicia 28 only allows players to determine the indicia 28 on the outer faces 30 of the game pieces 12, thereby introducing a certain amount of randomness to the outcome of each turn. However, each colour may be disposed instead on two opposite faces 30 of the game pieces 12 so as to allow each player to determine the placement of all the indicia 28 on each game piece 12 and thereby facilitate a more strategically-oriented game. Other indicia 28 and relative orientations thereof may be used if desired. Further, the indicia 28 may comprise a set of two or more different indicia elements without departing from the scope of the invention.

The stacking block game is played by first randomly depositing all but one of the game pieces 12 in layers in the interior 18 of the sleeve 14. In the preferred implementation of the invention, the stacking block game 10 includes twenty-five cuboid game pieces 12, and the sleeve 14 has a square transverse cross-section and is dimensioned to retain six layers of four game pieces 12. Each layer of game pieces 12 is arranged as two rows of two game pieces 12. In addition, each aperture 24 allows access to a single layer of the game pieces 12 and extends across substantially the entire width of the sides 20 to expose both of the game pieces 12 disposed immediately adjacent the respective side 20. The apertures 24 are also staggered, such that the apertures 24 in one pair of opposing sides 20 coincide with the even-numbered layers of game pieces 12 and the apertures 24 in the other pair of opposing sides 20 coincide with the odd-numbered layers of game pieces 12.

Preferably, each player is then assigned a different coloured indicia 28. The different indicia 28 may be assigned by each player rolling the remaining game piece 12*a* in turn, with the coloured indicia 28 on the uppermost face 30 of the remaining game piece 12*a,* after the remaining game piece 12*a* has come to rest, defining the coloured indicia 28 assigned to each player. Alternately, the stacking block game 10 may include three coloured cards (not shown), which are placed face down on the playing surface, and the coloured indicia 28 are assigned to each player by each player selecting one of the playing cards. However, as discussed below, the stacking block game may also be played without the players being assigned a coloured indicia 28.

One of the players is then elected to play first. The elected player rolls the remaining game piece 12*a,* and makes a note of the coloured indicia 28 shown on the uppermost face 30 of the remaining game piece 12*a* after the remaining game piece 12*a* has come to rest. The elected player then ejects one of the game pieces 12 from the interior 18 and out through one of the apertures 24 by pressing the remaining game piece 12*a* through another of the apertures 24 and against the outer face 30 of another of the game pieces 12 disposed opposite the game piece 12 to be ejected. As the cross-section of the game pieces 12 matches the transverse cross-section of the sleeve 14, the game piece 12 to be ejected readily slides between the adjacent side 20 and the adjacent game pieces 12, and out from the interior 18. Since the apertures 24 provided in opposing pairs of sides 20 coincide with common game piece layers, the game piece 12 to be ejected slides from its layer and out the aperture 24 opposite the aperture 24 through which the remaining game piece 12*a* is pressed while the remaining game piece 12*a* is being pressed into the interior 18.

As will be appreciated, since the apertures 24 in the sleeve 14, shown in FIG. 1, are staggered, the game pieces 12 provided in the even-numbered layers of game pieces 12 can only be ejected from the interior 18 along one axis, and the game pieces 12 provided in odd-numbered layers of game pieces 12 can only be ejected from the interior 18 along an axis transverse to the ejection axis of the even-numbered layers. Further, since each aperture 24 allows access to only a single layer of the game pieces 12, the game pieces 12 positioned in layers above and below the layer from which the ejected game piece 12 is ejected remain in place in the interior 18 of the sleeve 14 in their respective layers. However, in the variation shown in FIG. 3, the sleeve 214 includes apertures 24 which are disposed such that a portion of the layers are simultaneously accessible through the apertures 24 from all of the sides 20. Accordingly, the game pieces 12 may be ejected from the interior 18 along an axis parallel to any of the sides 20, with the floor 21 serving to avoid disturbing the game pieces 12 in the layers above and below the layer of the game piece 12 being ejected.

According to the preferred method of playing the stacking block game, each player is only allowed to press the remaining game piece 12*a* against a game piece 12 whose outer face 30 has a coloured indicia 28 matching the previously noted coloured indicia 28 of the remaining game piece 12*a.* As will be appreciated, the number of available game pieces 12 is limited to those game pieces 12 whose faces 30 match the previously noted coloured indicia 28 of the remaining game piece 12*a* and which are accessible through one of the apertures 24.

Each subsequent player then makes a note of the coloured indicia 28 shown on the uppermost face 30 of the ejected game piece 12. As above, each subsequent player ejects a game piece 12 through one of the apertures 24 by pressing the ejected game piece 12 through another of the apertures 24 and against another game piece 12 whose outer face 30 has a coloured indicia 28 matching the previously noted coloured indicia 28 of the ejected game piece 12. Generally, the players take turns ejecting game pieces 12 from the sleeve 14 and inserting the ejected game pieces 12 back into the sleeve 14. However, in one variation, if one of the players ejects a game piece 12 and the coloured indicia 28 noted on the uppermost face 30 of the ejected game piece 12 matches that player's assigned coloured indicia 28, the player repeats his/her turn and is allowed to press the ejected game piece 12 against any game piece 12 in the sleeve 14 regardless of the coloured indicia 28 shown on the outer face 30 of the game piece 12.

Preferably, the game continues until all twelve of the coloured indicia 28 adjacent one of the sides 20 match one of the player's assigned coloured indicia 28. To achieve this indicia solution, each player will generally select a side 20 and insert the ejected game piece 12 back into the sleeve 14 such that the face 30 having the coloured indicia 28 which matches that player's assigned coloured indicia 28 is positioned outwards adjacent the selected side 20. However, each player may also change the selected side 20 during the game, and may simultaneously select more than one side 20, if desired.

In one variation of the game, the mat 16 has demarcated zones 32 provided thereon, and the mat 16 is positioned such that the ejected game piece 12 lands on the mat 16. Sequence of play and/or the assigned coloured indicia 28 of a player then changes in accordance with the zone 32 in which the ejected game piece 12 comes to rest on the mat 16. For instance, the zones 32 of the mat 16 may comprise coloured zones 32, and the player ejecting the game piece 12 may be entitled to another tun if the coloured indicia 28 on the uppermost face 30 of the ejected game piece 12 matches the colour of the coloured zone 32. Alternately, the indicia 28 assigned to a player may change to the coloured indicia 28 on the uppermost face 30 if the ejected game piece 12 matches the colour of the coloured zone 32. The entitlement to another turn or the change of assigned indicia 28 may even be based on the lowermost face 30, if desired. Further, entitlement to another turn could be based on the uppermost face 30 with the change in assigned indicia 28 being based on the lowermost face 30, or vice versa. The mat 16 may also include zones (not shown) which require a player to lose a turn or entitle a player to a free turn. Other relations between the resting position of the ejected game piece 12 on the mat 16 and the coloured indicia 28 on a face 30 of the ejected game piece 12 will be apparent to those skilled in the art.

In another variation, rather than each player being only allowed to press the remaining game piece 12*a* against a game piece 12 whose outer face 30 has a coloured indicia 28 matching the previously noted coloured indicia 28 of the remaining game piece 12*a,* each player is allowed to press the remaining game piece 12*a* against any game piece 12 whose outer face 30 has a coloured indicia 28 which does not match the previously noted coloured indicia 28 of the remaining game piece 12*a.*

If a shorter game is desired, game play may continue until a portion of the coloured indicia 28 adjacent one of the sides match one of the player's assigned coloured indicia 28 reaches a predetermined number less than twelve, or if a portion of the coloured indicia 28 of adjacent game pieces 12 reaches a predetermined number. For further variety, in one variation, players are not assigned any coloured indicia 28, but are assigned a side 20, and game play continues until one of the assigned sides 20 shows a predetermined number of coloured indicia 28. This latter variation may be combined with the demarcated mat 16, described above, for added difficulty.

The foregoing description is intended only to be illustrative of the preferred embodiment of the invention. Those of ordinary skill will be able to make certain additions, deletions and/or modifications to the preferred embodiment without departing from the spirit or scope of the invention as defined by the appended claims.

We claim:

1. A stacking block game comprising:

a plurality of non-resilent game pieces stackable in layers, the game pieces including indicia on the faces thereof; and an elongate sleeve comprising a side wall defining an interior for retaining the game pieces in layers in the interior, and a plurality of apertures provided in the side wall and coinciding with the game piece layers, the apertures being dimensioned for sliding the game pieces therethrough.

2. The stacking block game according to claim 1, wherein the interior has a generally parallelogram-shaped transverse cross-section.

3. The stacking block game according to claim 1, wherein the interior has a rectangular-shaped transverse cross-section.

4. The stacking block game according to claim 1, wherein the sleeve has a generally parallelepiped shape.

5. The stacking block game according to claim 1, wherein the sleeve has a rectangular parallelepiped shape, and the side wall extends upwardly from a base.

6. The stacking block game according to claim 1, wherein each said game piece has a game piece width, and each said aperture has a width greater than the game piece width.

7. The stacking block game according to claim 1, wherein each said game piece has a game piece height, and each said aperture has a height greater than the game piece height.

8. The stacking block game according to claim 1, wherein each said game piece layer has a layer width, and the side wall comprises four planar sides, each said aperture having a width substantially equal to a width of the sides and greater than the layer width.

9. The stacking block game according to claim 1, wherein the side wall comprises four planar sides, the apertures in one of the sides coinciding with a first portion of the game piece layers, and the apertures in adjacent ones of the sides coinciding with a second portion of the game piece layers.

10. The stacking block game according to claim 9, wherein the first portion is different from the second portion.

11. The stacking block game according to claim 9, wherein the first portion is the same as the second portion.

12. The stacking block game according to claim 1, wherein the sleeve includes a plurality of planar floor members, each said floor member being disposed in the interior for supporting each said game piece layer.

13. The stacking block game according to claim 1, wherein the side wall comprises four planar sides, the apertures in one of the sides coinciding with alternate ones of the game piece layers, and the apertures in adjacent ones of the sides coinciding with the game piece layers disposed between the alternate game piece layers.

14. The stacking block game according to claim 1, wherein the side wall comprises four planar sides, each said game piece layer coinciding with one of the apertures in one of the sides and one of the apertures in an opposite one of the sides.

15. The stacking block game according to claim 1, wherein the interior has a transverse cross-section, and the game pieces have a cross-section substantially similar to the transverse cross-section.

16. The stacking block game according to claim 15, wherein the game pieces have a parallelepiped shape.

17. The stacking block game according to claim 15, wherein the game pieces have a cuboid shape.

18. The stacking block game according to claim 1, wherein the indicia comprises a set of three unique elements.

19. The stacking block game according to claim 18, wherein each said unique indicia element is disposed on adjacent ones of the game piece faces.

20. The stacking block game according to claim 18, wherein each said unique indicia element is disposed on opposite ones of the game piece faces.

21. A method of playing a game comprising the steps of:

providing a plurality of game pieces stackable in layers, the game pieces including indicia on the faces thereof;

depositing a portion of the game pieces in layers in an elongate sleeve, the sleeve comprising a side wall defining an interior and a plurality of apertures provided in the side wall aligned with the game piece layers;

ejecting one of the interior game pieces from one of the game piece layers by pressing an ejected one of the game pieces through one of the apertures and against another of the interior game pieces, the other game piece being disposed opposite said one interior game piece and being selecting in accordance with a set of rules; and repeating the ejecting step in a sequence amongst players of the game until a predetermined indicia solution is reached.

22. The method according to claim 21, wherein the set of rules comprises pressing the ejected one game piece against an outer one of the faces of the other game piece, the indicia of the outer one face being related to the indicia of one of the faces of the ejected one game piece.

23. The method according to claim 22, wherein the outer one face is identical to the indicia of an uppermost one of the faces of the ejected one game piece upon the ejected one game piece coming to rest after being ejected from the interior.

24. The method according to claim 21, wherein the set of rules comprises assigning a unique one of the indicia to the players, and each said player pressing the ejected one game piece, in turn, against an outer one of the faces of the other game piece and repeatedly performing the ejecting step when the indicia of an uppermost one of the faces of the ejected one game piece, upon the ejected game piece coming to rest after being ejected from the interior, matches the player's assigned indicia.

25. The method according to claim 21, wherein the side wall comprises four planar sides, the set of rules comprises assigning a unique one of the indicia to the players, and the predetermined indicia solution is reached when one of the players orients a predetermined portion of the indicia adjacent one of the sides identical to said player's assigned indicia.

26. The method according to claim 25, wherein the ejecting step includes ejecting the game pieces onto a mat, the mat including a plurality of zones, and the assigned indicia is related to a resting place of the ejected one game piece in the zones.

27. The method according to claim 25, wherein the ejecting step includes ejecting the game pieces onto a mat, the mat including a plurality of zones, and the sequence is related to a resting place of the ejected one game piece in the zones.

* * * * *